United States Patent [19]

Akesaka

[11] Patent Number: 4,624,605

[45] Date of Patent: Nov. 25, 1986

[54] SHIELD TUNNELING APPARATUS

[75] Inventor: Toshio Akesaka, Yokohama, Japan

[73] Assignee: Kabushiki Kaisha Iseki Kaihatsu Koki, Tokyo, Japan

[21] Appl. No.: 595,342

[22] Filed: Mar. 30, 1984

[30] Foreign Application Priority Data

Apr. 14, 1983 [JP] Japan ..... 58-64609

[51] Int. Cl.[4] ..... E21D 9/06; E02F 5/10

[52] U.S. Cl. ..... 405/144; 405/141; 405/184; 175/55; 299/56

[58] Field of Search ..... 405/138, 141–144, 405/146, 147, 184; 175/62, 94, 55, 343; 299/55, 56, 31, 33

[56] References Cited

U.S. PATENT DOCUMENTS

| | | | |
|---|---|---|---|
| 347,813 | 8/1986 | Legg | 299/55 |
| 1,001,903 | 8/1911 | Temple | 299/31 |
| 1,179,342 | 4/1916 | Wittich | 175/94 |
| 2,874,936 | 2/1959 | Gonzales | 405/184 X |
| 3,429,390 | 2/1969 | Bennett | 405/144 X |
| 3,830,545 | 8/1974 | Sugden | 405/144 X |
| 3,926,267 | 12/1975 | Svirchevsky et al. | 175/55 X |
| 4,311,411 | 1/1982 | Akesaka et al. | 405/184 |
| 4,403,890 | 9/1983 | Miyanagi et al. | 405/184 |
| 4,406,498 | 9/1983 | Akasaka | 405/144 X |
| 4,494,799 | 1/1985 | Snyder | 405/141 X |

*Primary Examiner*—Cornelius J. Husar
*Assistant Examiner*—Nancy J. Stodola
*Attorney, Agent, or Firm*—Kane, Dalsimer, Kane, Sullivan and Kurucz

[57] ABSTRACT

Method for thrusting a shield for use in tunneling includes the steps of causing a rotary head, provided at the front portion of a shield body, an eccentric motion so that earth, soil or sand covering the front of the shield is pressed away radially of the shield, and exerting a thrust on the shield body during the eccentric motion of said rotary head. Apparatus for carrying out the method includes a driven crank shaft or a driven eccentric straight shaft, a conical or frustoconical rotary head supported rotatably by the crank or eccentric straight shaft, conveyor for discharging mined material backwardly, and hydraulic jacks for imparting a thrust to the shield body.

3 Claims, 7 Drawing Figures

SHIELD TUNNELING APPARATUS

BACKGROUND OF THE INVENTION

1. Field of the Invention

The present invention relates to a shield tunneling method and apparatus, and more particularly to a method and apparatus for thrusting a shield, which is adapted for use in jacking pipes into the ground.

2. Description of the Prior Art

Generally, according to the pipe jacking method, as shown in U.S. Pat. No. 4,311,411, a shield is provided at the foremost part of a pipe to be thrusted and the ground is bored by the operation of an excavator attached to the shield, then by the subsequent operation of a hydraulic thrust jack disposed behind the pipe a thrust is exerted on the shield and the pipes, so that the shield and the pipes are thrusted into the bored portion of the ground. The above excavator is disposed rotatably in the front portion of the shield and is driven by a drive unit disposed behind a partition wall extending across the interior of the shield. During operation of the excavator, the cut surface of the ground or the tunnel face is maintained in a stable condition by being pressurized with pressurized water, sludge, etc.

Such preboring of the ground by the excavator diminishes the thrust resistance of the succeeding pipes, but since the pipes undergo an earth pressure acting on their circumference, the thrust resistance increases with adding of pipes required as the pipe thrusting proceeds and hence with increase of the overall length of pipes to be thrusted. Therefore, the above thrust jack must be large-sized enough to produce a large thrust. The foregoing earth pressure not only is an obstacle to the thrusting of a pipe but also continues to act on the circumference of the pipes after embedded in the ground and impedes a stable maintenance of the pipes.

On the other hand, the excavator for excavating the ground which covers the front of the shield requires a large-sized drive unit capable of producing a large driving torque for driving its rotary cutter head. This drive unit must be disposed within the shield, but in the case of a shield having a small outside diameter, e.g., 300 mm or so, there is no room for mounting therein a large-sized drive unit.

SUMMARY OF THE INVENTION

Accordingly, it is a primary object of the present invention to diminish the thrust resistance of a shield and the succeeding pipe or pipes induced by earth pressure thereby reducing the required thrust and attaining a permanent stability of the pipe embedded.

It is another object of the present invention to attain the reduction in size of a drive unit for driving a boring rotary head attached to a shield thereby attaining a further reduction in size of the shield and hence permitting the application of pipes of smaller diameters.

The present invention is based on the concept that a part or the whole of earth and sand which cover the front of a shield is thrusted away radially of the shield by means of a rotary head causing an eccentric motion, thereby forming a volumetric change in part of the ground which surrounds the shield, that is, forming a consolidated self-support zone in the ground.

The shield thrusting method of the present invention is characterized in that a conical or frustoconical rotary head supported by a crank shaft or an eccentrically disposed straight shaft at the front portion of a shield body is allowed to undergo an eccentric motion by driving the crank shaft and allowed to consolidate the ground, and in that a thrust is exerted on the shield body during such operation of the rotary head.

The shield thrusting apparatus of the present invention basically includes a crank shaft having one end supported rotatably by a partition wall extending across the interior of the shield body and connected to a drive mechanism behind the partition wall and the other end extending in front of the partition wall; a conical or frustoconical rotary head supported rotatably by the other end of the crank shaft; and a hydraulic means positioned behind the shield body for imparting a thrust to the shield body.

Further, the shield thrusting apparatus of the present invention includes an eccentric collar supported rotatably by a partition wall extending across the interior of the shield body, the eccentric collar being connected to a first drive mechanism; a crank shaft or an eccentrically disposed straight shaft connected to a second drive mechanism; a rotary head supported by the other end of the crank shaft or the straight shaft; and a hydraulic means positioned behind the shield body for imparting a thrust to the shield body, in which the crank shaft or the straight shaft itself is allowed to undergo an eccentric motion with respect to the shield body by the operation of the first drive mechanism and this eccentric motion is performed intermittently to form an appropriate extra space around the shield body, thereby facilitating the control or adjustment of the thrusting direction of the shield.

The features of the present invention will become more apparent from the following description of embodiments of the invention which are illustrated in the accompanying drawings.

DESCRIPTION OF PREFERRED EMBODIMENTS

Figure 1:
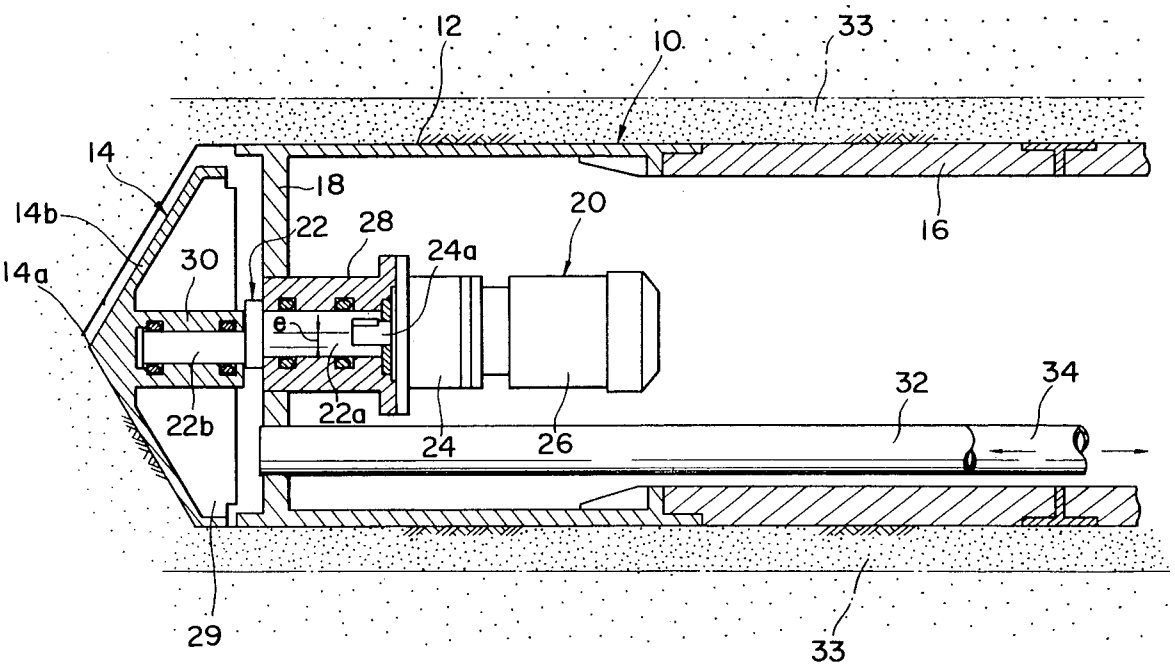
FIG. 1 is a longitudinal sectional view of an apparatus according to an embodiment of the present invention.

Referring first to FIG. 1, there is shown a shield thrusting apparatus 10 embodying the invention, which includes a conical rotary head 14 supported at the front portion of a shield body 12 and a hydraulic thrust jack (not shown) of a structure known per se for exerting a thrust on both the shield body and a concrete pin 16 contiguous to the rear portion of the shield body. The shield body 12 is provided with a partition wall 18 extending across the interior of the shield body, with a drive mechanism 20 for the rotary head 14 being supported by the partition wall 18.

The drive mechanism 20 includes a crank shaft 22 and a motor 26 connected to the crank shaft through a reduction gear 24. A shaft portion **22*a* on one end side of the crank shaft 22 is supported through a bearing 28 mounted to the partition wall 18 and is keyed to an output shaft 24***a* of the reduction gear 24. On the other hand, a shaft portion 22*b* on the other end side of the crank shaft 22 supports the rotary head 14 rotatably through a bearing 30 which is mounted to the rotary head together with an agitator plate 29. The crank shaft 22 has an amount of eccentricity corresponding to "e" (shown in FIG. 1) between its shaft portions 22*a* and 22*b*. The crank shaft 22 shown in the drawings is a single overhung solid crank shaft.

A pair of pipes 32 and 34 constitute means for discharging mined material from the forward zone of the partition wall 18 to the backward zone of the partition wall 18 and are attached to the partition wall 18 in lower positions of the wall so as to be open towards the front of the partition wall. The pipe 32 is a liquid feed pipe for feeding liquid such as fresh or muddy water ahead of the partition wall 18, while the pipe 34 is a liquid discharge pipe for discharging surplus water contained in the ground and muck together with the liquid fed.

Upon operation of the motor 26, the crank shaft 22 is rotated, so that the rotary head 14 undergoes an eccentric motion and comes into an intermittent contact with the ground. During this eccentric motion, the rotary head 14 exerts an urging force on the ground and at the same time receives a reaction force from the ground, so that it rotates by itself. The ground with the urging force exerted thereon is pressurized as a whole in the diametrical direction of the shield, which direction is attributable to the shape of the rotary head and the thrust acting from the rear, and the thus pressurized ground portion forms a consolidated zone 33 which surrounds the shield. The formation of the consolidated zone 33 is effective in diminishing the thrust resistance of the shield and reducing the earth pressure against the embedded pipe, thereby attaining stabilization of the pipe.

Where the ground is weak or soft, there will be little discharge of muck, but pore water present between soil particles will be separated upon consolidation of the ground and discharged through the liquid discharge pipe 34. In the case where the ground is hard or of a noncompressible nature such as rock bed, muck is formed by a squeezing or crushing action of the rotary head 14 and it is discharged through the discharge pipe 34.

The above-described action of the rotary head 14 supported by the driven crank shaft will be easily understood by recalling an internal gear type planetary reduction gear and by likening the action of an internal gear to the ground and that of a planetary gear to the rotary head. In this case, the rotary head corresponding to the planetary gear causes its transfer torque to be developed by virtue of a frictional force acting between the rotary head and the ground, and causes the resulting torque reaction to be borne by the shield body 12. Therefore, even if a small-sized reduction gear is used as the reduction gear 24 disposed between the crank shaft 22 and the motor 26 and the crank shaft is rotated at high speed and small torque, it is possible to develop a large torque according to the nature of the ground. As a result, it becomes possible to dispose a small-sized drive mechanism within a shield of a small diameter not having a large space, and this is extremely advantageous in realizing a shield having as small a diameter as possible.

The foregoing intermittent contact between the rotary head and the ground which occurs during the eccentric motion of the rotary head 14 is a contact of the rotary head with the ground in a linear portion extending from the tip end 14*a* of the rotary head to the rear end along the surface thereof. In order to enhance the squeezing or crushing action of the rotary head during such contact, it is advantageous to provide many chips or bits on a conical face plate 14*b* of the rotary head 14. Alternatively, convex and concave portions extending radially from the tip end 14*a* of the rotary head 14 may be provided in an alternately continuous manner in the form of a bevel gear.

Figure 2:
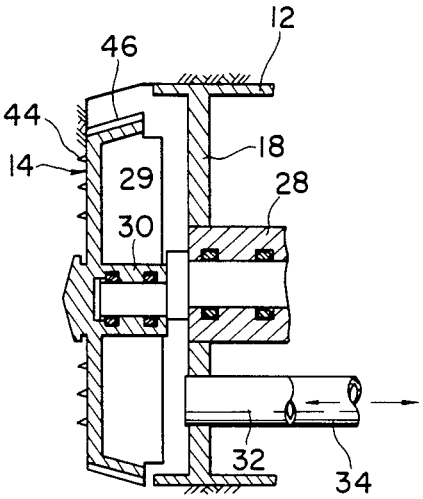
FIGS. 2 and 3 are partial longitudinal view and a front view, respectively, showing a modification of a rotary head.
Figure 3:
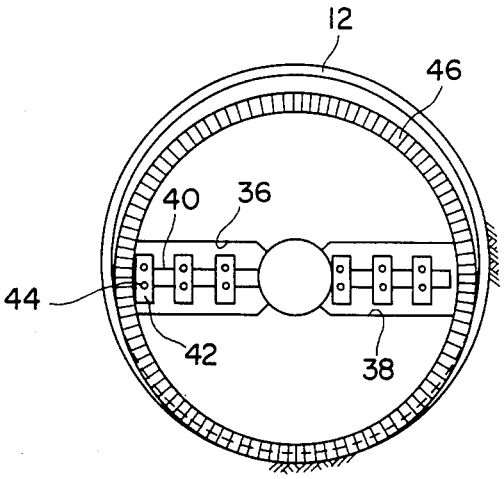

The rotary head 14 illustrated in FIGS. 2 and 3 has a generally frustoconical shape and is provided in its front surface as a vertical surface with slits 36 and 38 which are paired in the diametrical direction. Projecting foward from those slits are a large number of bits 44 attached to support members 40 and 42. Further, on the conical surface contiguous to the front surface is formed a saw tooth-like rugged portion 46 with convexes and concaves extending alternatively in the circumferential direction. The mucks formed by excavation with the bits 44 are sent backward through the slits 36 and 38 and collected to the lower portion of the partition wall 18 under the action of the agitator plate 29, then conveyed further backward through the discharge pipe 34. During the eccentric motion of the rotary head, the rugged portion 46 on the conical peripheral surface compresses the ground and at the same time exerts an effective squeezing or crushing force thereon.

Figure 4:
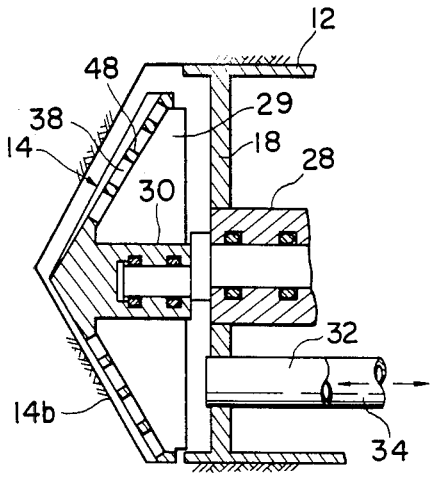
FIGS. 4 and 5 are a partial longitudinal sectional view and a plan view, respectively, showing a further example of a rotary head.
Figure 5:
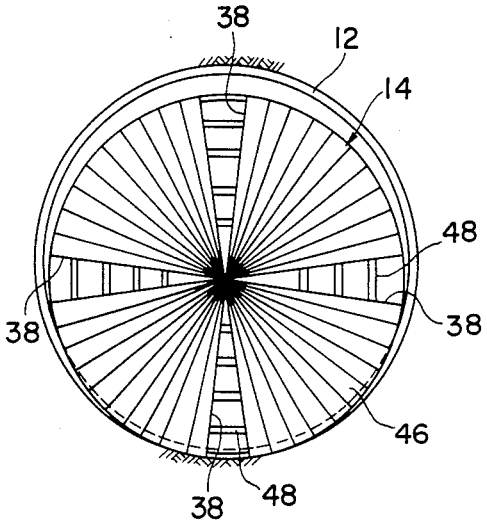

The rotary head illustrated in FIGS. 4 and 5 has four slits 38 formed in the conical face plate 14*b* and extending crosswise from the tip end 14*a*. Within each of the slits 38 are provided plural limit pieces or restrictors 48 at predetermined intervals for limiting the size of muck taken in therethrough. Further, on the conical face plate 14*b* is provided a rugged portion 46 extending from the tip end 14*a* radially backward. In place of the conical face plate illustrated, a plurality of spokes may be arranged at predetermined intervals on the conical plane of the generally conical rotary head, and in this case the aforementioned limit pieces are disposed at predetermined intervals between the spokes and a multitude of chips and/or bits are provided on the spokes.

Figure 7:
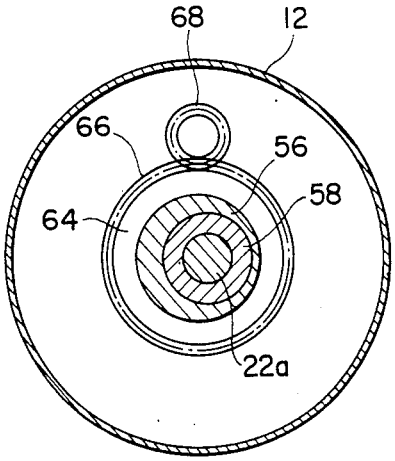
FIG. 7 is a transverse sectional view taken along line 7—7 in FIG. 6.
Figure 6:
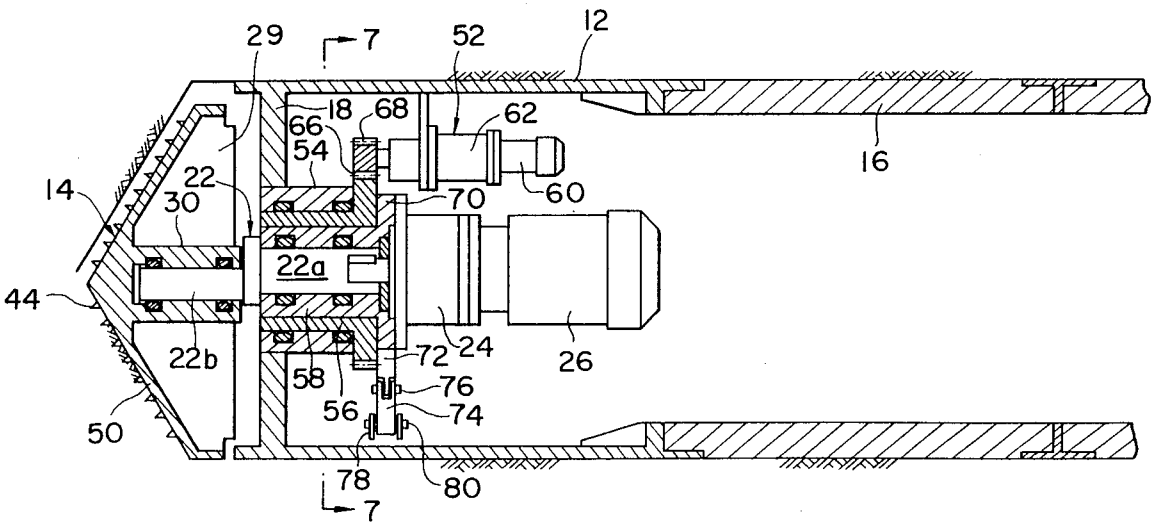
FIG. 6 is a longitudinal sectional view of an apparatus according to another embodiment of the present invention.

Referring now to FIGS. 6 and 7, there is illustrated another embodiment of the present invention, in which a large number of bits 44 are provided on spokes 50 which are arranged at predetermined intervals in the circumferential direction and there is provided a mechanism 52 whereby a shaft 22 (a crank shaft in the example shown) which supports the rotary head 14 is allowed to perform an eccentric motion with respect to the central axis of the shield body for forming an extra space. This eccentric motion mechanism 52 includes an eccentric collar 56 which is supported by the partition wall 18 through a bearing 54 and a sleeve 58 which is disposed in the eccentric collar 56. The mechanism 52 further includes a drive mechanism provided with a motor 60 and a reduction gear 62 whereby the eccentric collar 56 is driven and rotated through engagement of a gear 66 formed on the outer periphery of a flange 64 of the eccentric collar 56 with a gear 68 mounted on an output shaft of the reduction gear 62.

A shaft portion 22*a* of the eccentric shaft is received rotatably in the sleeve 58 and it is keyed at an end portion thereof to an output shaft of a reduction gear 24 which is connected to a motor 26. The sleeve 58 has a flange 70 and a bracket 72 integral with the flange. One end of a rocker arm 74 extending in the transverse direction of the shield body is pivotally connected to the bracket 72 through a pin 76, while the other end of the rocker arm 74 is pivotally connected through a pin 80 to a bracket 78 which is mounted to the shield body 12. Under the action of the rocker arm 74 the sleeve 58 performs an eccentric motion in accordance with the rotation of the eccentric collar 56, but its rotation about its own axis is prevented.

If the eccentric collar 56 is rotated at least once or rotated angularly during rotation of the crank shaft 22, the driven shaft itself which supports the rotary head 14 performs an eccentric motion about the axis of the shield body 12. Therefore, if the shaft portion on the reduction gear side of the driven shaft is held in the eccentric position when the driven shaft is a crank shaft or if the entirety of the driven shaft is held in the eccentric position when the driven shaft is an eccentrically disposed straight shaft, then by selecting the outside diameter of the rotary head suitably according to the diameter of the shield body, there can be formed an extra space having desired diameter and length through the overall circumference of the shield body or over a certain angular range, thereby permitting control of the thrusting direction of the shield body. The number of revolutions of the eccentric collar 56 can be set at about one twentieth of that of the crank shaft. Further, by controlling the operation of the drive mechanism 52, the rotation of the eccentric collar can be done continuously or intermittently according to the control for a desired shield thrusting direction.

An extra space for permitting the above-described thrusting direction control by the eccentric motion mechanism may be formed not only by a rotary head supported on a crank shaft but also by a rotary cutter fixedly supported on a straight shaft which is rotatably supported in a position eccentric to the axis of a shield.

I claim:

1. An apparatus for tunneling a shield having an outer diameter, comprising: an eccentric collar supported rotatably by a partition wall extending across the interior of a shield body, said eccentric collar being connected to a first drive mechanism for rotating said collar; a crank shaft connected to a second drive mechanism for rotating said crank shaft and a conical or frustoconical rotary head disposed ahead of said shield and supported by an opposite end portion of said crank shaft; said first and second drive means, eccentric collar and crank shaft cooperating to rotate said rotary head in an eccentric motion to compact ground ahead of the shield to form an annular space substantially equal to said outer diameter.

2. An apparatus according to claim 1, further comprising a sleeve disposed between said eccentric collar and said shaft, said eccentric collar being connected to said shield body through a rocker arm.

3. An apparatus according to claim 1, wherein said eccentric collar is provided with a flange having an external gear, and wherein said first drive mechanism includes a reduction gear and a motor connected to said reduction gear, said reduction gear being provided with an output shaft having a gear which engages said external gear of said eccentric collar.

* * * * *